United States Patent [19]

Roe

[11] 3,971,081

[45] July 27, 1976

[54] BOX SPRING UNIT WITH METAL SLATS

[75] Inventor: Richard C. Roe, Palatine, Ill.

[73] Assignee: Sealy, Incorporated, Chicago, Ill.

[22] Filed: Nov. 25, 1974

[21] Appl. No.: 526,951

Related U.S. Application Data

[63] Continuation of Ser. No. 451,170, March 14, 1974, abandoned, which is a continuation of Ser. No. 216,701, Jan. 10, 1972, abandoned.

[52] U.S. Cl. ..... 5/246; 5/263; 267/102

[51] Int. Cl.[2] ..... A47C 23/04

[58] Field of Search ..... 5/245–247, 5/263, 264, 259, 351; 267/102, 110

[56] References Cited

UNITED STATES PATENTS

| | | | |
|---|---|---|---|
| 570,425 | 10/1896 | Colvin | 5/264 R |
| 1,127,198 | 2/1915 | D'Arcy | 5/264 R |
| 1,545,461 | 7/1925 | Trimble | 5/264 R |
| 2,332,042 | 10/1943 | Asaro | 5/264 R |
| 3,131,405 | 5/1964 | Andes | 5/263 |
| 3,286,281 | 11/1966 | Slominski | 5/247 |
| 3,680,157 | 8/1972 | Slominski | 5/247 |

*Primary Examiner*—Casmir A. Nunberg

[57] ABSTRACT

A frame for a box spring unit utilizing torsion bar springs comprises a generally rectangular wood frame member and a plurality of parallel transverse metal slats secured to the frame member, the metal slats being adapted to precisely position and firmly secure the base of the torsion bar spring to the metal slat.

4 Claims, 2 Drawing Figures

10
12
14
16
18
20
22
24
26
28
30
32
34
36
36a
38
40
42
x
y
a

BOX SPRING UNIT WITH METAL SLATS

This is a continuation of application Ser. No. 451,170, filed Mar. 14, 1974 now abandoned which is in turn a continuation of application Ser. No. 216,701, filed Jan. 10, 1972 now abandoned.

The present invention relates to a box spring unit and, more particularly, to a frame for a box spring unit utilizing torsion bar springs.

Mattress box spring units generally comprise a base frame having mounted thereon coil springs or torsion bar springs, such as disclosed in U.S. Pat. No. 3,286,281, issued on Nov. 22, 1966 to Hoover Ball and Bearing Company. This invention relates to box spring units using torsion bar springs. It has heretofore been the practice in such units to utilize wood transverse slats in the base frame. However, the wood slats have many disadvantages. First, it is difficult to secure the torsion bar springs to the slats in the desired location. The failure to secure the torsion bar springs to the slat at the appropriate position detracts from the performance of the springs in the unit. Second, it is difficult to firmly secure the torsion bar springs to wood slats, staples generally being used, and there is a tendency for the torsion bar springs to loosen and thus impair their performance in the box spring unit. Third, a wood slat has irregular strength characteristics and will sag and/or break after repeated flexing incurred by use of the box spring.

It is an object of this invention to provide a base frame for a box spring unit which does not suffer from these disadvantages.

These and other objects, features and advantages of the present invention will be apparent from the following detailed description taken in conjunction with the accompanying drawings in which.

Figures 1, 2, 3:
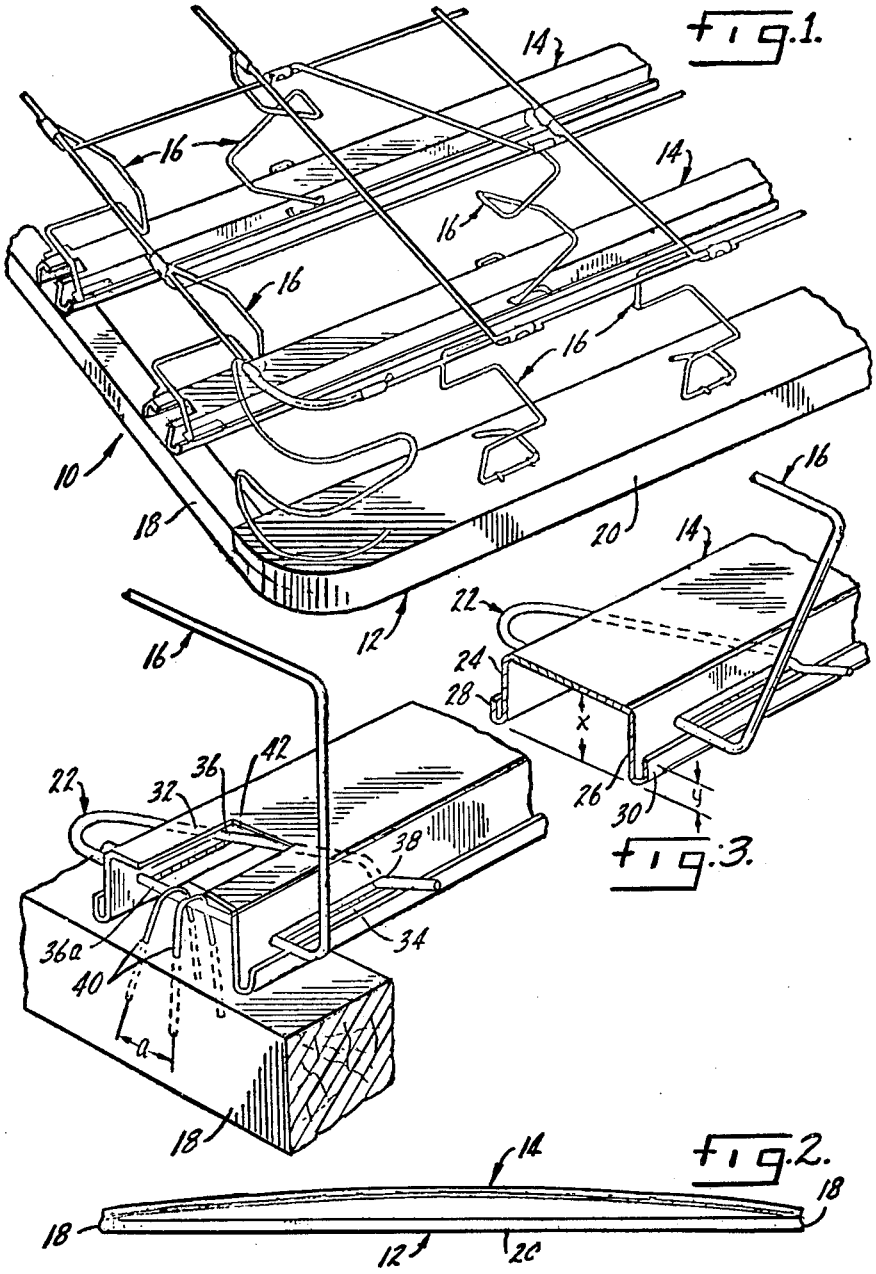
FIG. 1 is a fragmentary perspective view of the interior of a box spring unit utilizing torsion bar springs and embodying the features of the present invention.
FIG. 2 is an end view of the box spring unit of FIG. 1 without the torsion bar springs.
FIG. 3 is an enlarged fragmentary perspective view of a portion of the box spring unit of FIG. 1.

Referring now to the drawings, and in particular FIG. 1, there is illustrated a box spring unit embodying the features of the present invention and indicated generally by reference numeral 10. The box spring unit 10 comprises a wood base frame 12 with a plurality of transverse parallel metal slats 14 and a plurality of torsion bar springs 16 mounted upon and attached to the base frame 12 and slats 14. Torsion bar springs 16 are well known in the art and do not per se constitute a part of the present invention. The selection of the particular torsion bar springs to be utilized within the teachings of this invention would be a matter of choice within the ordinary skill of one in the art. Exemplary torsion bar springs for use in the box spring unit 10 are disclosed in U.S. Pat. No. 3,286,281 referred to hereinbefore.

In accordance with the present invention the slats 14 are made of metal, preferably steel, and have a built-in crown to compensate for the load created when the mattress is placed on the box spring unit 10 and to minimize deflection under normal usage, which in the case of wood slats often caused sagging of the slats. The slats 14 provide means for precisely positioning the torsion bar springs 16 in the box spring unit 10 and for firmly holding the torsion bar springs 16. In addition, the metal slats 14 do provide uniformity of strength throughout their length, which is not afforded by wood slats. Thus the metal slats 14 and the wood frame 12 overcome those disadvantages inherent in a wood base frame with wood slats.

The base frame 12 of the box spring unit 10 is rectangularly shaped with two wood side members 18 and two wood end members 20. The metal slats 14 are parallel to one another and extend transversely across the frame 12 parallel to the end members 20. As best seen in FIG. 2, the slats 14 have a built-in crown or arc which minimizes the slats 14 from setting or sagging with use.

The torsion bar springs 16 have a base 22 for attachment to the end members 20 or the slats 14. The base 22 of the torsion bar springs 16 is attached to the wood frame members 20 by staples, which do not firmly hold the torsion bar spring 16 in position and make it difficult to precisely position the torsion bar springs 16 in a box spring unit. These factors adversely affect the performance of these torsion bar springs 16 within a box spring unit.

In contrast, the metal slats 14 precisely position and firmly hold the other torsion bar springs 16 within the box spring unit 10. Referring particularly to FIG. 3, it will be seen that the metal slats 14 comprise inverted U-shaped members with legs 24 and 26 having roll back flanges 28 and 30, respectively. It has been found that optimum strength per material usage and cost is obtained when the ratio of height $x$ of metal slat 14 to the height $y$ of the roll back flanges 28, 30 is in the range of about 3.0 to 3.2.

The legs 24 and 26 each carry a plurality of slots which form pairs of aligned slots adapted to receive the base 22 of the torsion bars 16. For example, as illustrated in FIG. 3, slots 32 and 34 in legs 24 and 26, respectively, form a pair of aligned slots adapted to firmly and precisely position the base 22 of a torsion bar spring 16.

The base 22 is, in this instance, a generally V-shaped wire member having a leg 36 which may be moved by hand toward its other leg **36*a* so that the vertex of this member may be inserted sequentially through the slots 34 and 32 and the leg 36 released so that a groove 38 in the leg 36 engages the end of the slot 34 to firmly lock the base 22 in the metal slat 14. Similarly, there are a number of other aligned slots in legs 24 and 26, respectively, in the slat 14 that form pairs of slots adapted to receive the base 22 of the torsion bar springs 16 and positively position and firmly secure them to the metal slat 14**.

When the torsion bar spring 16 is attached to the very end of the metal slat 14, as illustrated in FIG. 3, staples 40 are used to hold the base 22 of the torsion bar spring 16 and the slat 14 to the frame member 18. The staples 40 pass over the leg **36*A*. Access to the leg 36*a* is available by virtue of a cut-out portion 42 in the end of the slat 14. For maximum rigidity the staples 40 should be centered in the portion 42 over the leg 36*a*** and be driven in at an angle $a$ to another in the range of about 15° to 30°.

The specific manner in which the torsion bars are firmly and precisely positioned by the metal slats 14 is not per se a part of the present invention, the foregoing being merely exemplary of a suitable technique. It will be understood that any means may be used with metal slats within the scope of the present invention.

While the embodiment described herein is at present considered to be preferred, it will be understood that various modifications and improvements may be made therein, and it is intended to cover in the appended claims all of such modifications and improvements as fall within the true spirit and scope of the invention.

What is claimed is:

1. A frame for a box spring unit utilizing torsion bar springs comprising a generally rectangular wood frame member and a plurality of parallel transverse metal slats secured to said frame member, said slats having means to precisely position and firmly secure a torsion bar spring thereto, said metal slats providing the sole means of support for said torsion bar springs on said frame, said metal slats having an inverted U-shaped cross-section with leg portions extending downwardly, said leg portions having roll-back flanges extending upwardly along a part of said leg portions, said metal slats having a built-in crown.

2. The frame of claim 1 wherein the ratio of height of the metal slats to height of the roll-back flanges is in the range of about 3.0 to 3.2.

3. A box spring unit comprising a generally rectangular wood frame member, a plurality of parallel transverse metal slats secured to said frame member and a plurality of torsion bar springs, said metal slats having means to precisely position and firmly secure a torsion bar spring thereto, said metal slats providing the sole means of support for said torsion bar springs on said frame, said metal slats having an inverted U-shaped cross-section with leg portions extending downwardly, said leg portions having roll-back flanges extending upwardly along a part of said leg portions, said metal slats having a built-in crown.

4. The box spring unit of claim 3 wherein the ratio of height of the metal slats to height of the roll-back flanges is in the range of about 3.0 to 3.2.

* * * * *